US009903357B2

(12) United States Patent
Dagdelen et al.

(10) Patent No.: US 9,903,357 B2
(45) Date of Patent: Feb. 27, 2018

(54) DEVICE FOR A HIGH-PRESSURE PUMP FOR A MOTOR VEHICLE

(71) Applicant: Continental Automotive GmbH, Hannover (DE)

(72) Inventors: Burhan Dagdelen, Wenzenbach (DE); Andreas Muehlbauer, Bernhardswald (DE); Rainer Weber, Regensburg (DE); Stephan Bias, Regensburg (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 0 days.

(21) Appl. No.: 15/031,372

(22) PCT Filed: Jun. 24, 2015

(86) PCT No.: PCT/EP2015/064306

§ 371 (c)(1),
(2) Date: Apr. 22, 2016

(87) PCT Pub. No.: WO2016/020106

PCT Pub. Date: Feb. 11, 2016

(65) Prior Publication Data

US 2017/0261115 A1 Sep. 14, 2017

(30) Foreign Application Priority Data

Aug. 8, 2014 (DE) ..... 10 2014 215 774

(51) Int. Cl.
*F04B 39/00* (2006.01)
*F02M 59/46* (2006.01)

(52) U.S. Cl.
CPC ..... *F04B 39/0055* (2013.01); *F02M 59/466* (2013.01); *F02M 2200/09* (2013.01); *F02M 2200/304* (2013.01)

(58) Field of Classification Search
CPC ..... F04B 39/0055; F02M 59/466; F02M 2200/304; F02M 2200/09
(Continued)

(56) References Cited

U.S. PATENT DOCUMENTS 4,646,976 A 3/1987 Rembold et al. ..... 239/585.3
4,821,774 A * 4/1989 Chorkey ..... F16K 31/0693 137/625.65

(Continued)

FOREIGN PATENT DOCUMENTS

DE 102004028886 A1 1/2006 ..... F02M 45/12
DE 102009046079 A1 5/2011 ..... F02M 51/00

(Continued)

OTHER PUBLICATIONS

International Search Report and Written Opinion, Application No. PCT/EP2015/064306, 13 pages, dated Oct. 15, 2015.

*Primary Examiner* — Eric Keasel
(74) *Attorney, Agent, or Firm* — Slayden Grubert Beard PLLC

(57) ABSTRACT

The present disclosure relates to a device for a high-pressure pump for a motor vehicle comprising a valve housing and an actuator assembly arranged substantially along the central axis of the valve housing. The actuator assembly may include a recess extending from a first end. The actuator assembly may include at least one hydraulic compensation opening extending through a wall of the actuator assembly from the recess into an exterior region. It may also include a volume body in the actuator recess spaced apart from the actuator assembly and extending into a region of the at least one hydraulic compensation opening. The volume body may be immovable relative to the valve housing. The actuator assembly may move along the central axis relative to the valve housing and relative to the volume body.

10 Claims, 3 Drawing Sheets

(58) Field of Classification Search
USPC ..... 251/129.07
See application file for complete search history.

(56) References Cited

U.S. PATENT DOCUMENTS

| | | | | | |
|---|---|---|---|---|---|
| 5,255,855 | A * | 10/1993 | Maier | ..... | F02M 51/0614 239/533.11 |
| 2015/0047726 | A1 | 2/2015 | Wilms et al. | ..... | 137/565.11 |

FOREIGN PATENT DOCUMENTS

| | | | | | |
|---|---|---|---|---|---|
| DE | 102010061793 | A1 | 6/2011 | ..... | F16K 31/06 |
| DE | 102012211394 | A1 | 1/2014 | ..... | F02M 59/36 |
| EP | 0195261 | A2 | 9/1986 | ..... | F02M 51/06 |
| WO | 2016/020106 | A1 | 2/1916 | ..... | F02M 59/36 |
| WO | 2013/092019 | A1 | 6/2013 | ..... | F02M 59/36 |

* cited by examiner

DEVICE FOR A HIGH-PRESSURE PUMP FOR A MOTOR VEHICLE

CROSS-REFERENCE TO RELATED APPLICATIONS

This application is a U.S. National Stage Application of International Application No. PCT/EP2015/064306 filed Jun. 24, 2015, which designates the United States of America, and claims priority to DE Application No. 10 2014 215 774.9 filed Aug. 8, 2014, the contents of which are hereby incorporated by reference in their entirety.

TECHNICAL FIELD

The present disclosure relates to a device for a high-pressure pump for a motor vehicle, and more particularly to a device suitable for minimizing vibrations and noise generated by valves.

BACKGROUND

In high-pressure pumps used in motor vehicles, magnetically actuated valves are used for the control of a fluid flow. Said valves are normally adjusted in an axial direction in order to adjust a flow cross section and provide a required quantity of a fluid, in particular fuel. Here, moving components impact, for structural space reasons, against delimiting elements which are intentionally incorporated in the construction in order to limit a stroke of the movable components of the valve. As a result of the impacting of moving components against non-moving, rigidly arranged components of the valve, an impetus is transmitted which leads to vibrations and which, scattered across the high-pressure pump, can be emitted as sound and is possibly perceptible as a disturbing noise.

SUMMARY

The teachings of the present disclosure may provide a device suitable for minimizing vibrations and noise generated by valves during operation of a motor vehicle.

In some embodiments, a high-pressure pump for a motor vehicle comprises a valve housing, a central axis and an actuator assembly, which is arranged substantially along the central axis in the valve housing. The actuator assembly has an actuator recess which extends from a first end of the actuator assembly into the actuator assembly. The actuator assembly has at least one hydraulic compensation opening which extends through a wall of the actuator assembly from the actuator recess into an exterior region. The device has a volume body arranged in the actuator recess so as to be spaced apart from the actuator assembly and which extends into a region of the at least one hydraulic compensation opening. The volume body is arranged to be immovable relative to the valve housing, while the actuator assembly is arranged to be movable axially with respect to the central axis, relative to the valve housing and relative to the volume body.

In this way, a device for a high-pressure pump for a motor vehicle is suitable for minimizing vibrations and noise generated by valves during operation of the motor vehicle. By way of the described device, during the operation of the motor vehicle, controlled hydraulic damping is realized which makes it possible for an impetus upon the impacting of moving components of the valve to adjacent, possibly rigidly fitted components to be reduced, in order that vibrations and generated noise are thereby reduced. Specifically, the hydraulic damping is realized by way of the volume body in the valve housing, which is arranged, in the valve housing, as a non-moving component of the device relative to the valve housing, and which changes a cross section and a volume for a through flowing fluid in a targeted manner.

During the course of operation of the motor vehicle, a fluid, in particular a fuel, flows through the high-pressure pump and corresponding valves. If a valve is designed according to teachings of the present disclosure, the flowing fluid passes into the valve housing and from therethrough the at least one hydraulic compensation opening into the region of the actuator recess. During an opening or closing of the valve, fluid flows into the actuator recess or out of the latter and thereby consequently permits hydraulic damping.

In this context, by way of the targeted installation of the volume body in the region of the actuator recess, a volume through which the fluid flows is changed in a controlled manner, and thus hydraulic damping of the moving actuator assembly is achieved. In this way, an impact force and a transmission of impetus of the moving actuator assembly to adjacent components of the valve is reduced. Consequently, a generation of vibrations and generation of noises during the operation of the valve is counteracted. Here, the actuator assembly may be in the form of a single element, for example in one piece, though may also comprise multiple components which are connected to one another for example in positively locking, non-positively locking and/or cohesive fashion.

The described hydraulic damping is realized by way of the volume body which, as an additional component of the valve, is arranged rigidly in the valve housing. Movable components of the device, such as for example the actuator assembly, are accordingly not changed. In this way, an increase of the mass of moving components is avoided, which would lead to an increased impetus in the case of movement of said components. Furthermore, with the volume body as rigidly arranged component of the valve, it is possible in a simple manner to realize substantially passive hydraulic damping of the through flowing fluid, without the need, for example, to actively adjust a hydraulic damping action. An active hydraulic damping action is achieved, for example in the case of a solenoid valve, by virtue of an actuator being energized and oppositely energized in order to weaken an impact against adjacent components. This inevitably requires additional electrical power and leads to increased fuel consumption of the motor vehicle, which is avoided for example by way of the described device.

A number of hydraulic compensation openings is not restricted to one, and may be scaled as desired such that the at least one or more hydraulic compensation openings extend through the wall of the actuator assembly and connect the actuator recess to the exterior region of the actuator assembly. Furthermore, a geometry of the at least one hydraulic compensation opening is variable and may be formed in a manner determined by the structural space. For example, it is advantageous for multiple hydraulic compensation openings to be drilled into the wall of the actuator assembly.

A geometry of the volume body can also be scaled as desired in a manner determined by the structural space, such that it is at least ensured that the volume body is arranged spaced apart from moving components of the valve and does not come into contact therewith during operation of the motor vehicle, and that a controlled change of the volume through which the fluid flows is realized. Furthermore, it is also possible for multiple volume bodies to be arranged in the valve housing or in the actuator recess, which volume bodies perform the functions just described.

In some embodiments, the actuator assembly comprises an actuator and a valve needle which, in an operating state, in interaction with a sealing seat, prevents flow of a fluid when the actuator assembly is in a closed position and otherwise permits said flow of fluid. Here, the actuator of the actuator assembly has the actuator recess, and the at least one hydraulic compensation opening is formed substantially between the actuator and the valve needle.

Here, the volume body is arranged in the actuator recess so as to be spaced apart from the actuator and, during an opening or closing process, projects into the region of the at least one hydraulic compensation opening, such that, for example, the moving valve needle of the actuator assembly moves toward the volume body or away from the latter. This is dependent inter alia on whether the valve is for example an outwardly opening valve or an inwardly opening valve. The actuator of the actuator assembly in this case comprises, for example, an armature, or else may itself be referred to as armature.

In some embodiments, the volume body is of substantially cylindrical form. In this way, the volume body is of rotationally symmetrical form, which, for example in conjunction with a through flowing fluid, permits a homogeneous flow profile, and thus controlled hydraulic damping, during the operation of the motor vehicle.

In some embodiments, the volume body extends substantially along the central axis or is arranged at least substantially parallel to the central axis. In this way, a rotationally symmetrical construction of the device is made possible, which permits a valve with hydraulic damping. For example, the actuator, the valve needle, and the actuator recess of the actuator assembly are also of rotationally symmetrical form and arranged axially with respect to the central axis, and thus, in a simple and symmetrical manner, realize controlled hydraulic damping of the moving actuator and of the moving valve needle before the latter impacts, for example, against the valve housing.

In some embodiments, the device comprises a pole piece which is arranged adjacent to the actuator of the actuator assembly and by means of which the actuator assembly can be magnetically opened or closed. Here, the volume body extends substantially from the first end of the actuator assembly into the region of the at least one hydraulic compensation opening.

In this way, it is for example the case that a magnetically actuable valve for the control of the fluid flow is realized, in the case of which controlled hydraulic damping of the through flowing fluid and of the moving components of the valve is realized by way of the arranged volume body. In this context, it is for example the case that, during the operation of the valve, the moving actuator assembly impacts, by way of the actuator, against the adjacent pole piece and thereby causes an impetus to be transmitted, which consequently leads to vibrations and noise generation. By way of the volume body, the impact is dampened, and the transmission of impetus is reduced, which consequently counteracts the generation of vibrations and the generation of noise.

In some embodiments, the volume body is coupled in cohesive and/or non-positively locking and/or positively locking fashion to the pole piece. This illustrates possibilities for the way in which the volume body can be rigidly and immovably arranged in the valve housing. For example, the volume body and the pole piece may be welded, adhesively bonded or clamped to one another and thus arranged jointly and immovably in the valve housing, whereas the actuator and the valve needle of the actuator assembly are arranged in the valve housing so as to be axially movable relative to the volume body and relative to the pole piece.

In some embodiments, the pole piece has a pole recess in which the volume body is partially arranged. In this way, a part of the volume body is pressed into the pole recess of the pole piece, whereby, for example, a non-positively locking connection of the volume body to the pole piece is realized.

In some embodiments, the volume body is formed integrally with the pole piece.

In some embodiments, a high-pressure pump comprises a device according to the first aspect.

BRIEF DESCRIPTION OF THE DRAWINGS

Exemplary embodiments of the invention will be discussed in more detail below on the basis of the schematic drawings, in which.

Elements of identical construction or function are denoted by the same reference designations throughout the figures.

DETAILED DESCRIPTION

Figure 1:
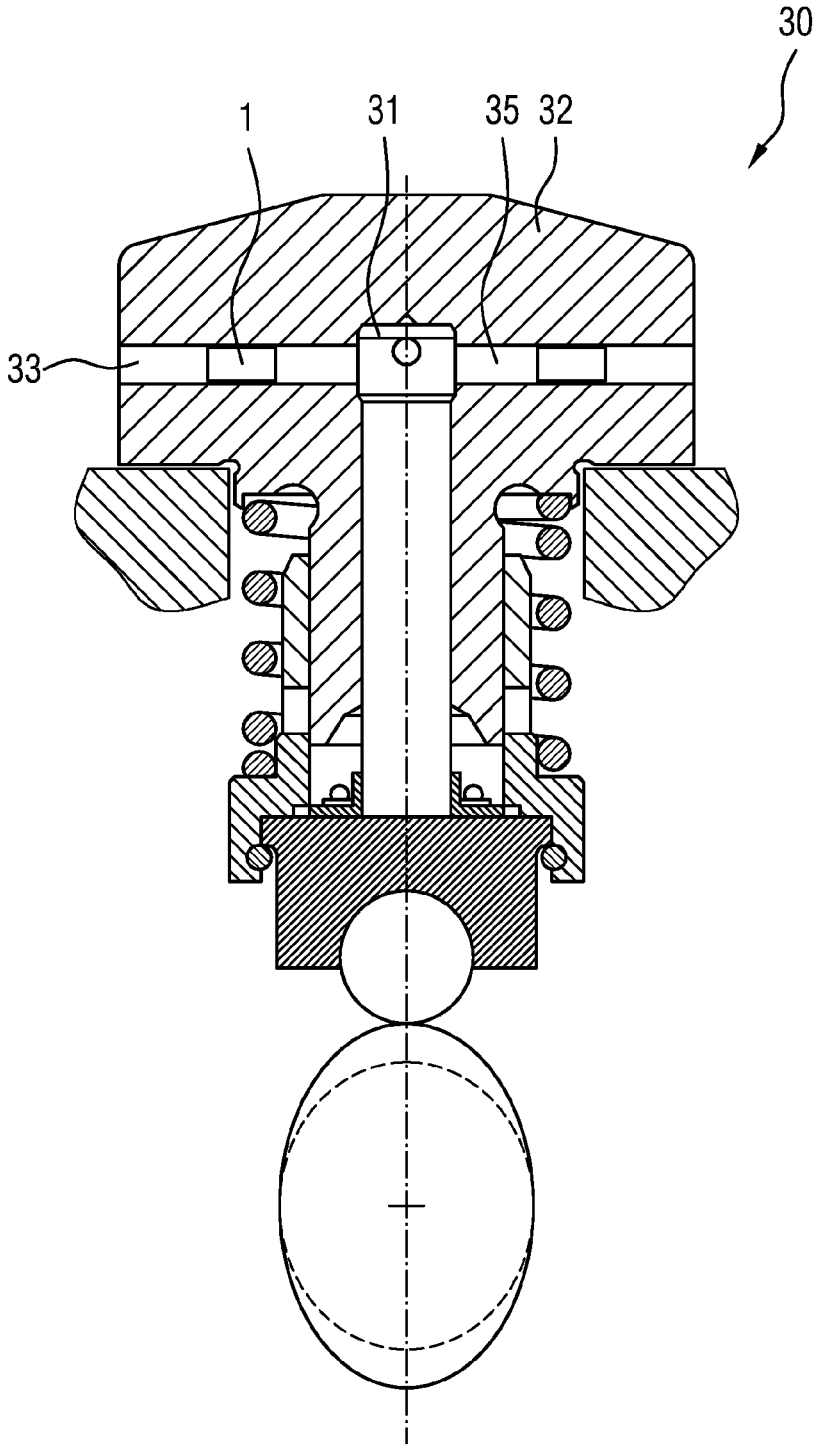
FIG. 1 is a schematic illustration of a high-pressure pump according to teachings of the present disclosure.

FIG. 1 schematically shows a high-pressure pump 30 including a fluid supply line 33. The fluid supply line 33 is hydraulically coupled to a cylinder chamber 31. The high-pressure pump 30 furthermore has a fluid discharge line 35. The cylinder chamber 1 is arranged hydraulically between the fluid supply line 33 and the fluid discharge line 35. The high-pressure pump 30 is a high-pressure pump for a fuel injection system for internal combustion engines of motor vehicles.

A pump housing 32 of the high-pressure pump 30 surrounds the cylinder chamber 1 and the fluid supply line 33 to the cylinder chamber 31, and the fluid discharge line 35. During a suction phase of the high-pressure pump 30, fluid is sucked into the cylinder chamber 31 from a low-pressure region through the fluid supply line 33. For example, the fluid supply line 33 is hydraulically coupled by way of a pre-delivery pump (not explicitly illustrated) to a fluid tank (not explicitly illustrated). In the fluid supply line 33 there is arranged a valve 1 which controls an admission of the fluid into the cylinder chamber 31.

The fluid is thereupon charged, in the cylinder chamber 31, with a pressure, for example as a result of a piston movement in the cylinder chamber. The pressurized fluid is discharged from the cylinder chamber 31 through an outlet valve, and out of the high-pressure pump 30 via the fluid discharge line 35. For example, the fluid discharge line 35 is coupled to a rail of a common-rail injection system. The high-pressure pump 30 is for example designed to provide pressures of up to 2000 bar or higher. In the exemplary embodiment illustrated, the high-pressure pump 30 is a piston pump, though the high-pressure pump may also be of some other type of construction.

Figure 2A:
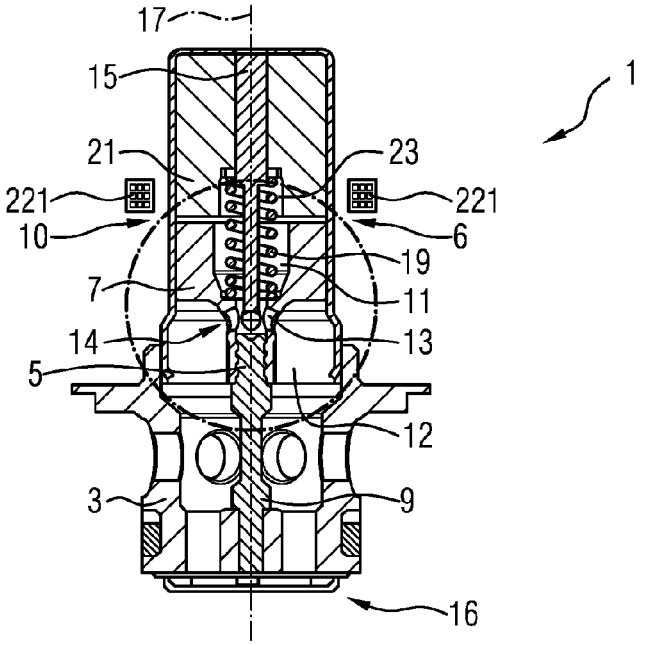
FIGS. 2A-2B show an example outwardly opening valve in an open position.
Figure 2B:
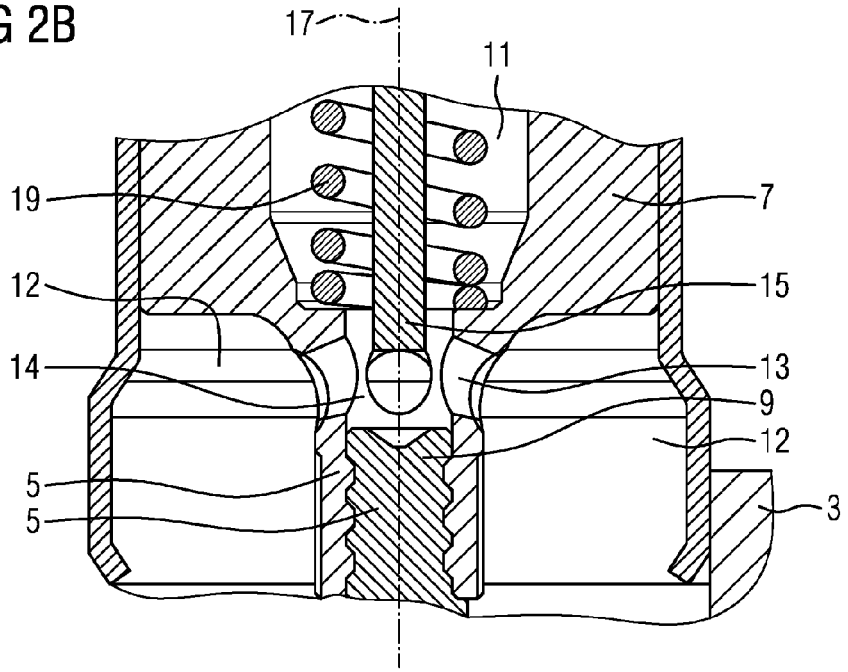

FIGS. 2A and 2B show, in a cross section, an exemplary construction of the valve 1, which is magnetically actuable and which comprises a valve housing 3, a central axis 17 and an actuator assembly 5. The actuator assembly 5 is, with respect to the central axis 17, arranged in the valve housing 3 so as to be axially movable relative to the valve housing 3, and in this exemplary embodiment, has an actuator 7 and a valve needle 9 which, during operation of the valve 1, in interaction with a sealing seat 16, prevents a flow of a fluid when the actuator assembly 5, composed of actuator 7 and valve needle 9, is in a closed position and otherwise permits said flow of fluid. The actuator 7 of the actuator assembly 5 comprises, for example, an armature, or else may itself be referred to as armature.

Furthermore, in the valve housing 3, there are arranged a pole piece 21 and a spring 19, which realize an opening and closing process of the valve 1. In this context, the spring 19 exerts a spring force on the actuator assembly 5, and thereby pushes the actuator 7 of the actuator assembly 5 away from the pole piece 21. Without energization of the pole piece 21, that is to say without the application of a voltage to a magnetic coil 211 that is wound around the pole piece 21, the valve 1 is thus permanently open. If the pole piece 21, that is to say the coil 211 wound around said pole piece, is energized, magnetic closure of the valve 1 is made possible by virtue of a magnetic force generated as a result of the energization of the pole piece 21 exceeding the spring force, and thereby accelerating the actuator 7 of the actuator assembly 5 in the direction of the pole piece 21. In this context, with regard to magnetically actuable valves, a distinction is made for example as regards whether said valves are open when deenergized or closed when deenergized. The valve 1 described here is, as already described, open when deenergized. In further exemplary embodiments, the valve 1 may also be designed so as to be closed when deenergized.

In this embodiment, the actuator 7 of the actuator assembly 5 has, in the region of a first end 6 of the actuator assembly 5, an actuator recess 11 which extends into the actuator assembly 5 and in which there is arranged, inter alia, a part of the spring 19. Furthermore, the pole piece 21 also has a pole recess 23, into which the spring 19 extends. Between the actuator 7 and the valve needle 9 there are formed hydraulic compensation openings 13 which, during the operation of the valve 1, permit the fluid flow from an exterior region 12 of the actuator assembly 5 into the actuator recess 11.

In the actuator recess 11 and in the pole recess 23 there is arranged a volume body 15 which extends as far as into a region 14 of the hydraulic compensation openings 13. In this exemplary embodiment, the volume body 15 is for example connected in non-positively locking fashion to the pole piece 21, and has for example been pressed into the pole piece 21 during the course of a production process. The volume body 15 is of substantially cylindrical form and has, in the pole recess 23, a relatively broad body and, in the actuator recess 11, a relatively narrow cylindrical body in the form of a pin. In further exemplary embodiments, the volume body 15 may have other geometrical shapes.

FIG. 2B illustrates the region 14 of the hydraulic compensation openings 13 of the valve 1 in detail. Said view shows a part of the actuator assembly 5 and of the actuator 7 and of the valve needle 9 on an enlarged scale. During the operation of the valve 1, the fluid, for example a fuel, flows into the valve 1 and the valve housing 3 and arrives at the region 14 of the hydraulic compensation openings 13. Subsequently, the fluid flows through the hydraulic compensation openings 13 and thus passes into the actuator recess 11 of the actuator 7 of the actuator assembly 5. In this context, the fluid flows around the volume body 15 and the spring 19, such that a flow profile of the fluid through the volume body 15 is influenced. The volume body 15 changes a volume, which is accessible for the fluid, in the region 14 of the hydraulic compensation openings 13, such that controlled hydraulic damping of the fluid and of the moving components of the valve 1 is achieved.

In an open position of the valve 1, a stroke 10 exists between the pole piece 21 and the actuator 7 of the actuator assembly 5, said stroke being formed for example in a predefined manner in a construction of the valve 1. Furthermore, in the open position of the valve 1, the volume body 15 does not project into the region of the hydraulic compensation openings 13, and thus does not influence the cross section and the volume of the hydraulic compensation openings 13 for the fluid flowing through. During the course of a closing process, the stroke 10 between the pole piece 21 and the actuator 7 is closed by virtue of the pole piece 21 being energized and the magnetic force thus generated exceeding the spring force exerted by the spring 19. Here, fluid is forced out of the actuator recess 11 through the hydraulic compensation bores 13, and thus passes into the exterior region 12 of the actuator assembly 5.

Figure 3A:
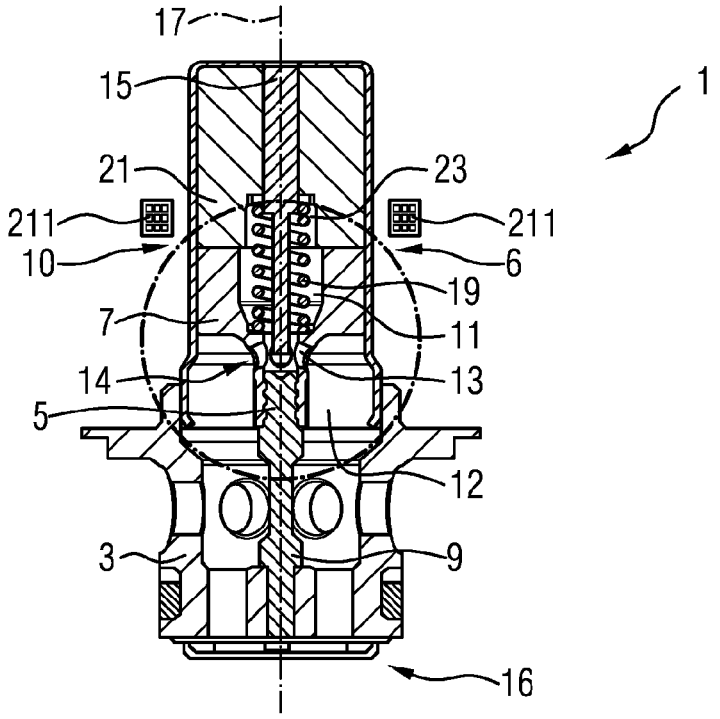
FIGS. 3A-3B show an example outwardly opening valve in a closed position.

FIG. 3A shows the valve 1 in a cross section in the closed position, in which the volume body 15 projects into the region 14 of the hydraulic compensation openings 13. In the course of the closing process, the volume body 15 has changed the cross section and the volume in the region 14 of the hydraulic compensation openings 13 and thereby targetedly influenced an outflow of the fluid out of the actuator recess 11.

In this way, controlled hydraulic damping is realized which slows a movement of the actuator 7 in the direction of the pole piece 21 and thereby reduces an impact force and a transmission of impetus to the pole piece 21 and/or to the valve housing 3. This has the advantageous effect that generation of vibrations and of noise is counteracted.

Owing to the volume body 15, the through flowing fluid has less volume available to it as it flows out of the actuator recess 11 through the hydraulic compensation openings 13, such that the movement of the actuator assembly 5 is influenced by a throttled movement of the fluid.

Figure 3B:
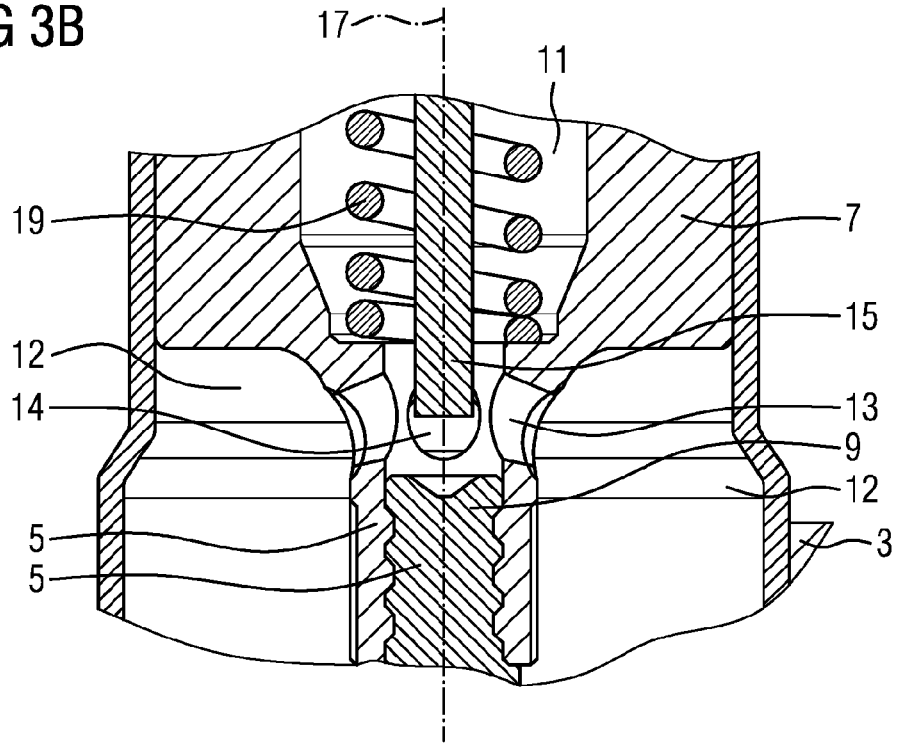

FIG. 3B shows the valve 1 illustrated in FIG. 3A in a closed position, in a detail view of the region 14 of the hydraulic compensation openings 13. By contrast to the position from FIGS. 2A and 2B, the volume body 15 projects by way of one end into the region 14 of the hydraulic compensation openings 13 and thereby changes the volume accessible to the fluid flowing through. Said change in volume correspondingly also has an effect during a subsequent opening process of the valve 1, such that, owing to the volume body 15, it is for example also the case that the movement of the valve needle 9 during the opening of the valve 1 is dampened for the reasons described above, and the impact force and transmission of impetus are reduced.

The valve 1 illustrated in FIGS. 2A, 2B, 3A and 3B thus permits, in a simple manner by way of the rigidly arranged volume body 15, hydraulic damping of the moving components of the valve 1, such as for example the actuator 7 and the valve needle 9 of the actuator assembly 5, during an opening and closing process of the valve 1.

In this way, movably arranged components of the valve 1 are not changed, such that, for example, a mass of the actuator assembly 5 also remains unchanged. An arrangement of the volume body 15 for example on the actuator assembly 5 may also, under some circumstances, lead to damping of a movement of the actuator assembly 5, though also leads, owing to the increase of the moving mass, to an increased impetus, which in turn reduces a desired hydraulic damping action. Such interaction is avoided by way of the exemplary embodiments described.

Furthermore, the hydraulic damping action is realized in a substantially passive manner by way of the volume body 15, because the volume body 15, as a rigid component of the valve 1, is arranged so as to be immovable, for example relative to the valve housing 3. Active hydraulic damping is achieved, for example in the case of a solenoid valve, by virtue of the pole piece 21 being energized and oppositely energized, in order to thereby weaken the impacting of the actuator 7 against the pole piece 21 or the impacting of the valve needle 9 against the valve housing 3. This inevitably requires additional electrical power, leading to increased fuel consumption of the motor vehicle.

In addition to the described hydraulic damping by way of the volume body 15, a further beneficial effect is achieved by virtue of the spring 19 being arranged around the volume body 15. In this way, the volume body 15 also has a spring-guiding action, because the spring 19 is guided on an internal diameter of the volume body 15.

Furthermore, a number of hydraulic compensation openings 13 is not restricted, and may in this context be scaled as desired, such that the at least one or more hydraulic compensation openings 13 extend through the wall of the actuator assembly 5 and connect the actuator recess 11 to the exterior region 12 of the actuator assembly 5. Furthermore, a geometry of the at least one hydraulic compensation opening 13 is also variable, and may be formed in a manner determined by the structural space. For example, it is advantageous for multiple hydraulic compensation openings 13 to be drilled through the wall of the actuator assembly 5.

A geometry of the volume body 15 can also be scaled as desired in a manner determined by the structural space, such that it is at least ensured that the volume body 15 is arranged spaced apart from moving components of the valve 1, such as the actuator 7 and the valve needle 9 of the actuator assembly 5, and does not come into contact therewith during operation of the motor vehicle. Here, by way of the volume body 15, a controlled change of the volume in the region 14 of the hydraulic compensation openings 13, through which volume the fluid flows during operation of the motor vehicle, is realized at all times. Furthermore, it is also possible for multiple volume bodies 15 to be arranged in the valve housing 3 or in the actuator recess 11, which volume bodies perform the functions described.

The invention claimed is:

1. A device for a high-pressure pump for a motor vehicle, the device comprising:

a valve housing having a central axis, and an actuator assembly arranged substantially along the central axis within the valve housing, the actuator assembly comprises an actuator and a valve needle which, in interaction with a sealing seat, prevents a flow of a fluid when the actuator assembly is in a closed position and otherwise permits said flow of fluid, wherein the actuator assembly includes an actuator recess extending from a first end of the actuator assembly into the actuator assembly, the actuator includes the actuator recess, and the at least one hydraulic compensation opening is formed substantially between the actuator and the valve needle, wherein the actuator assembly includes at least one hydraulic compensation opening extending through a wall of the actuator assembly from the actuator recess into an exterior region, and a volume body arranged in the actuator recess spaced apart from the actuator assembly and extending into a region of the at least one hydraulic compensation opening, wherein the volume body is immovable relative to the valve housing, and the actuator assembly moves along the central axis relative to the valve housing and relative to the volume body.

2. The device as claimed in claim 1, wherein the volume body is of substantially cylindrical form.

3. The device as claimed in claim 1, wherein the volume body extends substantially along the central axis or is arranged at least substantially parallel to the central axis.

4. The device as claimed in claim 1, further comprising:

a pole piece arranged adjacent to the actuator of the actuator assembly and by means of which the actuator assembly can be magnetically opened or closed, and wherein the volume body extends substantially from the first end of the actuator assembly to the region of the at least one hydraulic compensation opening.

5. The device as claimed in claim 4, wherein the volume body is coupled in cohesive fashion to the pole piece.

6. The device as claimed in claim 4, wherein the pole piece has a pole recess in which the volume body is partially arranged.

7. The device as claimed in claim 4, wherein the volume body is formed integrally with the pole piece.

8. The device as claimed in claim 4, wherein the volume body is coupled in non-positively locking fashion to the pole piece.

9. The device as claimed in claim 4, wherein the volume body is coupled in positively locking fashion to the pole piece.

10. A high-pressure pump for a motor vehicle, the high-pressure pump comprising:

a pressure chamber fed by a fluid supply line, a valve housing having a central axis and disposed in the fluid supply line, and an actuator assembly arranged substantially along the central axis within the valve housing, wherein the actuator assembly includes an actuator recess extending from a first end of the actuator assembly into the actuator assembly, wherein the actuator assembly includes at least one hydraulic compensation opening extending through a wall of the actuator assembly from the actuator recess into an exterior region, and a volume body arranged in the actuator recess spaced apart from the actuator assembly and extending into a region of the at least one hydraulic compensation opening, wherein the volume body is immovable relative to the valve housing, and the actuator assembly moves axially along the central axis, relative to the valve housing and relative to the volume body.

* * * * *